United States Patent [19]

Gorman et al.

[11] 4,086,645

[45] Apr. 25, 1978

[54] REPULSION COIL ACTUATOR FOR HIGH SPEED HIGH POWER CIRCUITS

[75] Inventors: Joseph G. Gorman, Murrysville; John M. Hicks, Verona; Francis Alan Holmes, Monroeville, all of Pa.

[73] Assignee: Electric Power Research Institute, Inc., Palo Alto, Calif.

[21] Appl. No.: 769,941

[22] Filed: Feb. 18, 1977

[51] Int. Cl.[2] ..... H01H 47/22

[52] U.S. Cl. ..... 361/155; 200/144 R; 335/177; 335/266; 361/194; 361/210

[58] Field of Search ..... 361/154, 155, 194, 210; 335/177, 266, 268; 200/144 R, 148 A

[56] References Cited

U.S. PATENT DOCUMENTS

| | | | |
|---|---|---|---|
| 3,524,958 | 8/1970 | Frink | 200/148 A |
| 3,531,608 | 9/1970 | Bateman | 335/177 |
| 3,534,304 | 10/1970 | Robinson et al. | 335/177 |
| 3,549,842 | 12/1970 | Fischer et al. | 200/148 A |
| 3,551,623 | 12/1970 | Colclaser, Jr. | 200/148 A |
| 3,614,543 | 10/1971 | Dick | 361/154 |

*Primary Examiner*—Gerald Goldberg
*Attorney, Agent, or Firm*—Flehr, Hohbach, Test, Albritton & Herbert

[57] ABSTRACT

A pair of pancake-like coils have a coil axis substantially colinear with one coil mounted to a framework and the other coil mounted on a movable member. The coils are wound such that when electrically energized simultaneously the resulting magnetic fields are in opposition, thereby producing a repelling force therebetween. A spring is disposed between the framework and the movable member to urge the movable member in a sense opposite to the repelling force. A power supply is connected to the coil pair providing for a high initial energy transfer and a lower sustaining energy transfer. A shock absorber is mounted on the framework to arrest the moving member which is set in motion by the repelling force. An armature is attached to the moving member which enters the field of a holding coil as the moving member is displaced by the repelling force. When the holding coil is energized with the armature situated therein, the moving member is held against the spring force.

13 Claims, 7 Drawing Figures

REPULSION COIL ACTUATOR FOR HIGH SPEED HIGH POWER CIRCUITS

BACKGROUND OF THE INVENTION

This invention relates to an actuator for separating electrical contacts and more particularly to such an actuator which provides rapid contact separation in a high power circuit.

It is a common requirement in high power circuits to have electrical contacts which under particular conditions must be opened or closed in extremely short periods of time. Accelerating attraction or repulsion coils are known for imparting motion to moving members carrying electrical contacts to thereby cause separation between the moving contact and a stationary contact. Devices utilizing such coils are disclosed in U.S. Pat. Nos. 3,524,957; 3,524,958; and 3,524,959 all issued Aug. 18, 1970. Multiple coil assemblies for causing separation of contacts in high power circuits are shown in U.S. Pat. No. 3,590,188 issued June 29, 1971; U.S. Pat. No. 3,551,623 issued Dec. 29, 1970; U.S. Pat. No. 3,531,608 issued Sep. 29, 1970; and U.S. Pat No. 3,549,842 issued Dec. 22, 1970.

In a high power AC circuit the advantage of opening or closing electrical contacts in time periods much less than half a cycle of the AC wave is evident when it is considered that the circuit may be thereby broken during one of the short periods of time when the instantaneous power in the circuit is relatively low. This requires precise timing of the actuation of the contacts such that opening and closing takes place at or near one of the AC wave zero crossing points. Consequently, a mass carrying one of the contacts must be moved over a distance in an extremely short period of time. If the mass is of the order of a few kilograms, the distance a few centimeters, and the time in the order of a millisecond, it may be seen that large forces must be generated to obtain the desired result. Known methods and structure for obtaining rapid contact opening and closing include imparting a destructive hammer blow to the mass carrying the moving contact. Other structure and methods include provision of repulsion coils and supplying excessive power to the coils, thereby overheating and subjecting the coils to excessive voltage stress, so that a flash over problem exists as the insulation between the coil turns is "punched through".

A repulsion coil actuator is needed which provides a high rate of contact separation without damaging the coils in the actuator, and which also provides for absorbing kinetic energy and contact latching after actuation.

SUMMARY AND OBJECTS OF THE INVENTION

This invention relates to a device which provides rapid separation of electrical contacts in a high power circuit. A framework is provided on which is mounted a repulsion coil. A moving member is disposed for motion relative to the framework. Another repulsion coil is mounted on the moving member having a coil axis which is substantially colinear with the axis of the repulsion coil mounted on the framework. A moving electrical contact is attached to the moving member and a static electrical contact is attached to the framework. A two stage power supply provides a high initial energy transfer rate and a lower sustaining energy transfer rate. Connection of the two stage power supply to the two repulsion coils causes magnetic fields to exist about the coils which are in opposition and which provide a high repulsion force therebetween setting the moving member in motion and separating the static and moving contacts.

It is an object of the present invention to provide a repulsion coil actuator with high initial moving contact acceleration without overheating the repulsion coils.

Another object of the present invention is to provide a repulsion coil actuator with a shaped force pulse to obtain efficient high speed contact separation.

Another object of the present invention is to provide a repulsion coil actuator having a controlled latch for maintaining electrical contacts in an open condition.

Additional objects and features of the invention will appear from the following description in which the preferred embodiments are set forth in detail in conjunction with the accompanying drawings.

DESCRIPTION OF THE PREFERRED EMBODIMENTS

Figure 1:
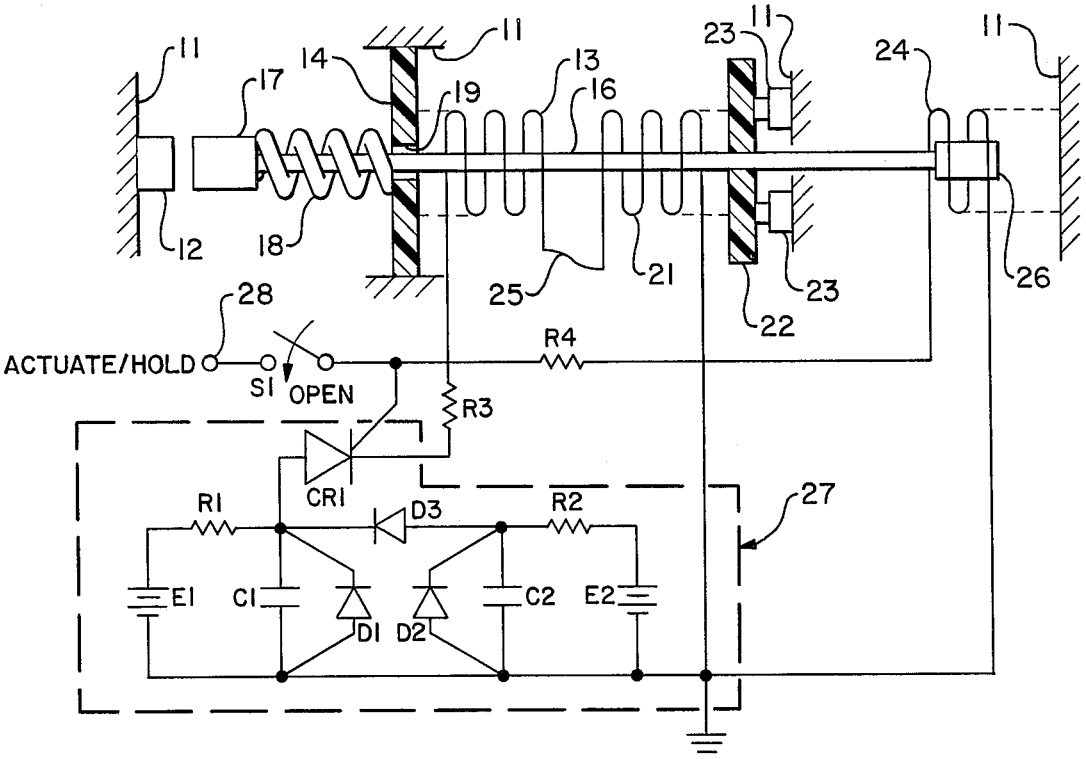
FIG. 1 is a combination mechanical and electrical schematic drawing showing the repulsion coil actuator.

In FIG. 1 a framework 11 is shown having a static contact 12 attached thereto. A static repulsion coil 13 is shown by dashed lines as being mounted to an insulating plate 14 secured to framework 11. A moving member is depicted by shaft 16 which has a moving contact 17 attached to the end thereof in juxtaposition with static contact 12. A spring 18 is disposed between insulating plate 14 and moving contact 17. The force in spring 18 has a sense which urges moving contact 17 into electrical contact with static contact 12. Shaft 16 is seen to pass through a hole 19 in insulating plate 14 aligned with the central axis of static propulsion coil 13.

A moving repulsion coil 21 is shown by dashed lines to be attached to a moving insulating plate 22, which in turn is shown to be firmly attached to shaft 16. A number of shock absorbers 23 are shown mounted on framework 11 disposed to contact moving insulating plate 22. Consequently, the kinetic energy which is imparted to shaft 16 when it is set in motion during the opening of static and moving contacts 12 and 17 respectively is absorbed, and damaging impact loads on the structure of moving member or shaft 16 and associated parts are avoided.

In this embodiment both moving repulsion coil 21 and holding coil 24 have central axes which are substantially colinear with the axis of shaft 16. Static and moving repulsion coils 13 and 21 respectively have a flexible conducting lead 25 therebetween so that relative movement between the two coils is allowed. A holding coil armature 26 is shown mounted on shaft 16 disposed within holding coil 24 when static and moving contact 12 and 17 are opened. In the embodiment of FIG. 1 static and moving repulsion coils 13 and 21 are shown connected in series and have a winding direction such that simultaneous electrical excitation produces magnetic fields therearound which are in opposition. It should be noted that parallel connection of repulsion coils 13 and 21 would also produce the results hereinafter described. As a consequence, moving repulsion coil 21 will be moved by the repelling force between the opposing magnetic fields and will travel away from static repulsion coil 13 causing moving insulating plate 22 and shaft 16 to move therewith. Moving contact 17 is thereby separated from static contact 12 by a distance sufficient to open a high power circuit. A spring force is stored in spring 18 as a result of the compression imposed thereon due to the displacement of moving member 16. This stored spring force urges contacts 12 and 17 toward electrical contact. However, when field coil 24 is energized with armature 26 therein, moving member 16 is fixed in position thereby holding contacts 12 and 17 in the open condition against the spring force in spring 18. When holding coil 24 is subsequently deenergized, the spring force will cause moving member 16 to be displaced so that contacts 12 and 17 are disposed in electrical contact.

The two stage power supply 27 is shown connected in circuit with the series connected static and moving repulsion coils 13 and 21 respectively. A switch S-1 is shown connected to a terminal 28 which in turn is connected to an actuate/hold signal. An SCR power switch CR1 has a gate connected to one side of switch S-1. Holding coil 24 is also seen to be connected between switch S-1 and ground.

One side of static repulsion coil 13 is connected through a resistor R3 to the cathode of CR1 in two stage power supply 27. A pair of high voltage DC sources E1 and E2 are shown connected to charge capacitors C1 and C2 through resistors R1 and R2 respectively. Protective diodes D1 and D2 are connected across C1 and C2 respectively. A switching diode D3 is connected between capacitors C1 and C2. In the instances where supply E1 is greater than supply E2 and where capacitor C1 has a lesser charge storage capability than capacitor C2, a high initial energy transfer rate will occur when CR1 is gated to the on condition as capacitor C1 discharges through resistor R3 into repulsion coils 13 and 21. Subsequently energy transfer at a sustaining rate will occur from capacitor C2 through switching diode D3 to repulsion coils 13 and 21 as described before.

Figure 2:
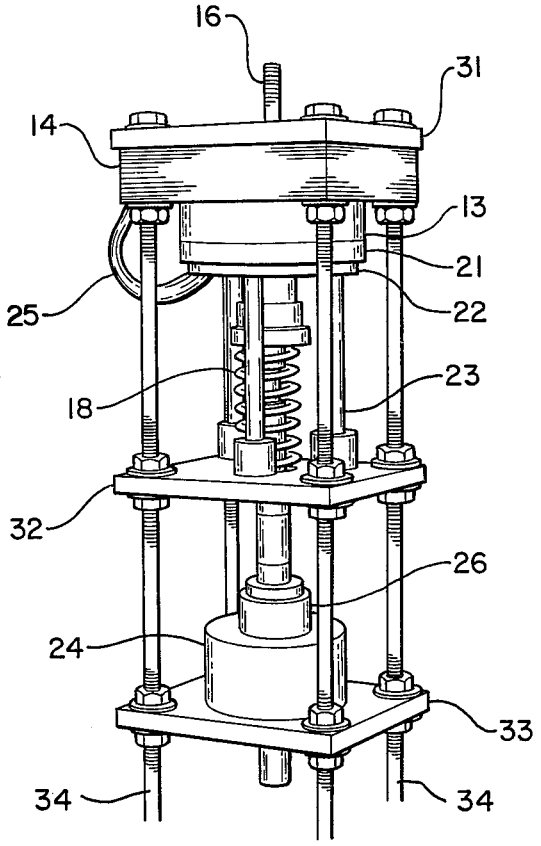
FIG. 2 is an isometric view of one embodiment of the repulsion coil actuator.

One embodiment of the repulsion coil actuator described in conjunction with FIG. 1 is shown in the isometric drawing of FIG. 2. Moving member or shaft 16 is shown centrally located in the assembly. Insulating plate 14 is shown with static repulsion coil 13 mounted thereon. Moving repulsion coil 21 is shown mounted to moving insulating plate 22 which in turn is attached to shaft 16. Spring 18 for reclosure of contacts 12 and 17 is shown surrounding a portion of shaft 16. Shock absorbers 23 are shown disposed to contact the back of moving insulating plate 22 when static and moving repulsion coils 13 and 21 are separated. Latch armature 26 is shown attached to shaft 16, and field coil 24 is shown mounted in a position to surround armature 26 when static and moving repulsion coils 13 and 21 are forced apart and moving insulating plate 22 is in contact with shock absorbers 23. Framework 11, in this embodiment, has a main support plate 31, a shock absorber support plate 32 and a latch support plate 33. Plates 31, 32 and 33 are connected together by four main tie rods 34. As shown in FIG. 2, insulating plate 14 is attached to main support plate 31, shock absorbers 23 are mounted on shock absorber support plate 32 and holding coil 24 is mounted on latch support plate 33. Flexible conducting leads 25 are shown extending between repulsion coils 13 and 21.

One particular configuration of static and moving repulsion coils 13 and 21 includes 100 turns of 16 strand AWG 25 insulated copper wire. Approximately 1600 strand turns per coil result. The coils are wound such that the generated magnetic fields are in opposition when they are electrically energized. A repulsion force therefore occurs between the coils 13 and 21. When static coil 13 is fixed to main support plate 31 and moving repulsion coil 21 is fixed to moving shaft 16, very large forces are exerted to drive shaft 16 in a direction along its own elongate axis and the substantially colinear axes of coils 13 and 21.

The design of the repulsion coils 13 and 21 involve a balance between the electrical properties of self-inductance, resistance and mutual inductance. It is appropriate to use as small a force as possible in obtaining the necessary acceleration of the moving member or shaft 16. Two air core coils are utilized instead of one energized coil and a conducting disc, because when using a conducting disc the force generated is primarily a function of the rate of rise of the current in the coil. The two coil system disclosed herein, on the other hand, generates a force proportional to the square of the current through the coils. Magnetic fields having high flux density are necessary in order to generate the large forces required using relatively small coils. The requisite flux densities are beyond the saturation limits of ferromagentic materials, which dictates that only air core coils are practical in this application.

The mutual inductance of the two repulsion coils 13 and 21 should be large compared to their self-inductance. At the same time the rate of change of mutual inductance as a function of separation between the coils must be large. In theory mutual inductance between two identical coils can be equal to the self-inductance of each coil, and there would result no unbalanced force to repulse the coils one from the other. Some mechanical asymmetry is therefore necessary. Consequently the coils are designed to provide a large variation in mutual inductance as a function of coil separation distance.

The rate of rise of the current through the repulsion coils 13 and 21 and therefore the rise of the repulsion force therebetween, should occur in a very short time compared to the travel time for full displacement of shaft 16. This requires a small initial inductance in the repulsion coils 13 and 21.

The energy available for doing mechanical work in this system is proportional to the mutual inductance of the coil pair while the energy stored in the self-inductance is lost. Consequently a high ratio of mutual to self-inductance is desirable. Energy loss also occurs in the system in the resistance of the coil pair which is minimized by maintaining a high ratio of inductive reactance to resistance. The present design accomplishes reduction in resistance by the use of thin wire to reduce the skin effect resistance, and also by the use of many strands of conductive wire in parallel to produce a small over-all resistance.

The direction of winding of repulsion coils 13 and 21 is such that when current flows through the coils the magnetic field produced by one coil has a sense in opposition to that produced by the other. Consequently, a repulsion force is produced between the coils. Factors which influence the repulsion force are the coil inductance and coil current. The inductance of each coil includes the self-inductance of the coil and a mutual inductance due to the presence of the other coil. The mutual inductance tends to reduce the total inductance when the coils are connected electrically. Thus, as separation increases between coils 13 and 21, the total inductance also increases. The repulsion force exerted between repulsion coils 13 and 21 is a function of the rate of change of energy delivered to the coil pair. This relationship is seen in formula form as follows:

$$F_c = \frac{d}{dx}(E) = \frac{d}{dx}\left(\frac{1}{2}Li^2\right)$$

Figure 3:
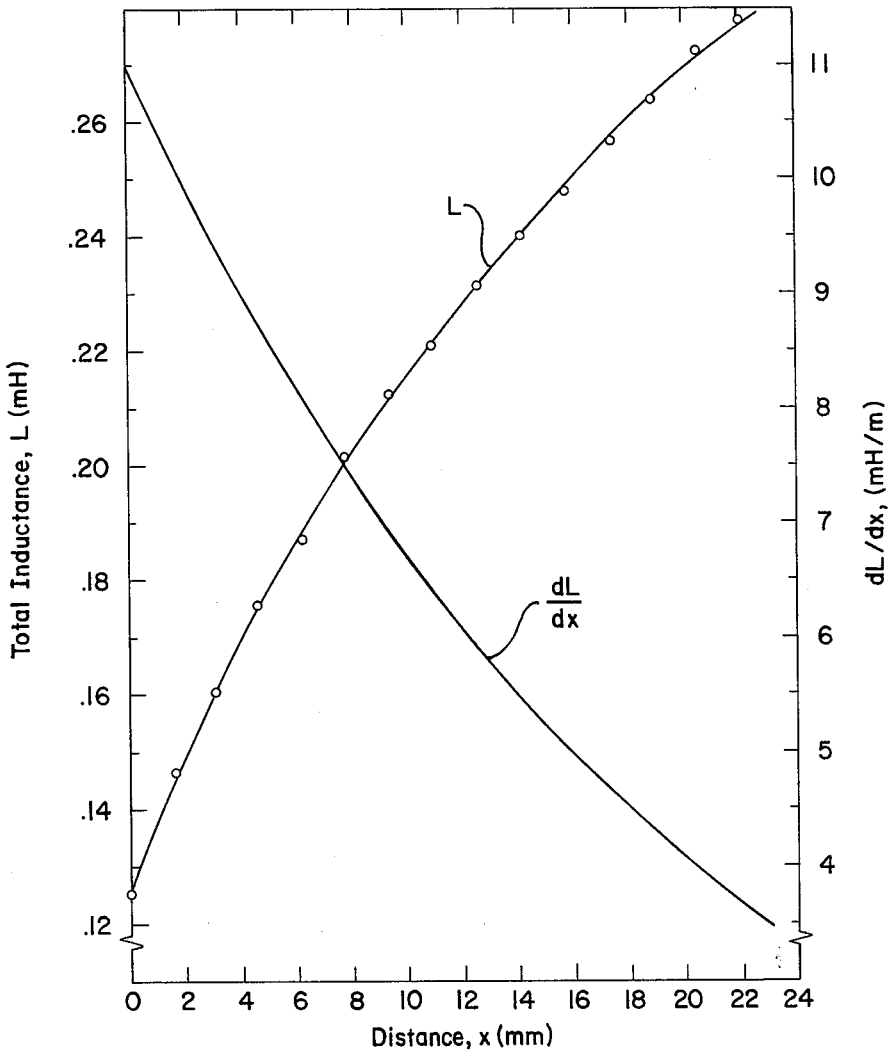
FIG. 3 is a graph showing variation in repulsion coil characteristics as a function of separation distance.

To design the power supply using the above referenced relationship for repulsion force, it is necessary to determine the relevant electrical characteristics of the repulsion coils 13 and 21. Self-inductance and coil resistance may be measured so that specific relations of total inductance as a function of separation distance between the repulsion coils 13 and 21 and change of total inductance as a function of change in separation distance may be determined. Having these relationships and considering further restraints such as that the repulsion coils must not be overheated nor subjected to excessive voltage stress and that there must be a rapid buildup of current through the coils, the power supply required may be specified. A typical variation of total induction as a function of repulsion coil separation distance and change in total inductance for change in coil separation is seen in FIG. 3 of the drawings. These relationships exist for a pair of repulsion coils 1.27 centimeters thick, 3 centimeters inside diameter, 11 centimeters outside diameter and utilizing the 100 turns of 16 strand AWG No. 25 insulated copper wire discussed above.

To serve the repulsion coils 13 and 21 the two stage power supply 27 seen in FIG. 1 was developed. E1 is greater than E2 and C2 is greater than C1. Consequently, a high initial rate of energy transfer is available from power supply 27 as capacitor C1 is discharged and a lower sustaining energy transfer rate is provided as capacitor C2 is discharged through repulsion coils 13 and 21. Two stage power supply 27 requires less stored energy and produces less heating of repulsion coils 13 and 21 than known supplies.

Figure 4:
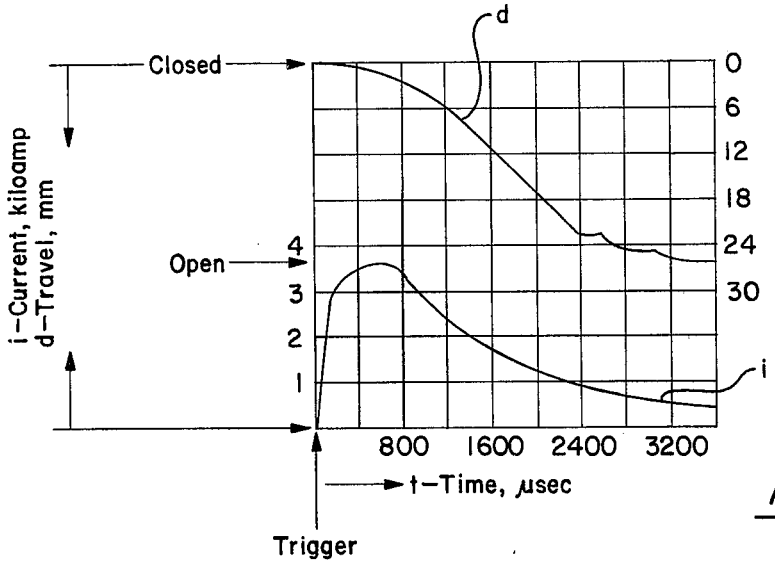
FIG. 4 is a graph showing coil current and moving contact travel as a function of time.

Referring to FIG. 4 coil current and separation distance of coils 13 and 21 or separation of contacts 12 and 17 as a function of time after closing switch S1 is shown. Note that maximum current is provided a short time after switch closure. Also note that the required coil separation or travel of shaft 16 is achieved to obtain an open condition at contacts 12 and 17 within the time the tailored power supply 27 provides power for the disclosed purpose. A maximum velocity of contact travel is seen at the steepest slope in this example to be approximately 17 meters per second. The mass of the moving system in this example is approximately 2 kilograms.

Figure 5:
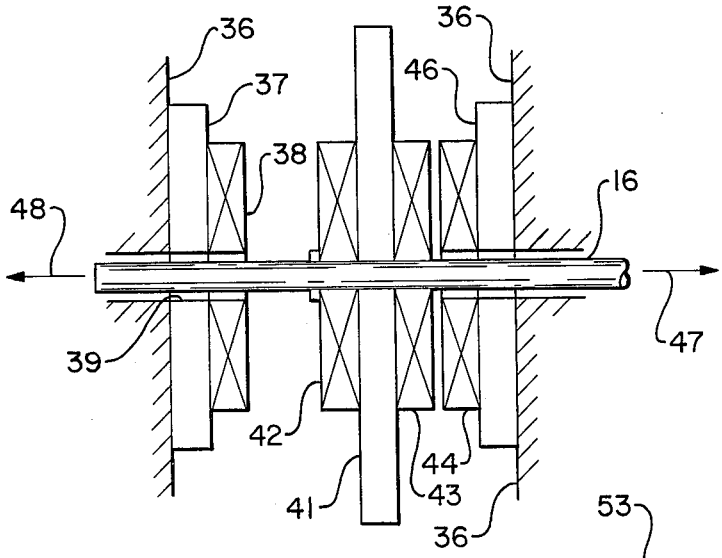
FIG. 5 is a side elevation sectional view of another embodiment of the repulsion coil actuator.

FIG. 5 shows an embodiment wherein the repulsion coil pairs disclosed above may be used to urge a moving member such as shaft 16 selectively in opposed directions to thereby open and close contact pairs for example. A framework 36 has mounted thereon a fixed insulating plate 37 to which is attached a static repulsion coil 38. An opening 39 is formed through framework 36, insulating plate 37 and repulsion coil 38 in which shaft 16 is disposed so that it may move relative to framework 36 along the axis of repulsion coil 38. An insulating support plate 41 is mounted on shaft 16 having a moving repulsion coil 42 mounted on one side and another moving repulsion coil 43 mounted on the opposite side thereof. Adjacent to moving repulsion coil 43 is another static repulsion coil 44 fixed to an insulating plate 46 which is also attached to framework 36. In accordance with the disclosure heretofore, the first pair of repulsion coils 38 and 42 are wound in a direction to provide a repulsion force therebetween when electrically energized, as is the second pair of repulsion coils 43 and 44. Consequently, selection of coil pair 38 and 42 to be electrically energized causes shaft 16 to move to the right as indicated by arrow 47 in FIG. 5. Conversely selection of coil pair 43 and 44 to be electrically energized causes shaft 16 to move to the left as indicated by arrow 48 in FIG. 5. Thus, in accordance with previous description herein, coil pair 38 and 42 could be energized for fast opening of electrical contacts and pair 43 and 44 could be energized for fast closing.

Figure 6:
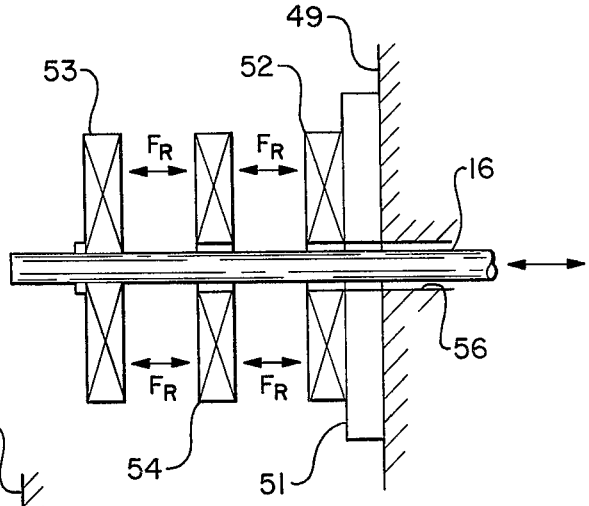
FIG. 6 is a side elevation sectional view of an additional embodiment of the repulsion coil actuator.

FIG. 6 shows a repulsion coil assembly which produces a large force over a larger distance or stroke for shaft 16. As before, a framework 49 has mounted thereon an insulating plate 51 with a repulsion coil 52 attached thereto. A moving repulsion coil 53 is attached to moving member or shaft 16. A floating repulsion coil 54 is disposed between repulsion coils 52 and 53. The longitudinal axis of shaft 16 extends along the substantially colinear axes of repulsion coils 52, 53 and 54. Adjacent repulsion coil pairs 52/54 and 54/53 are wound so that when electrically energized a repulsion force results between adjacent coils. Shaft 16 passes through an aperture 56 formed through insulating plate 51 and framework 49. Repulsion coil 54 floats relative to both shaft 16 and framework 49. It may be seen, therefore, that the stroke or motion of shaft 16, when all three repulsion coils 52, 53 and 54 are energized, is extended over a greater distance along the substantially colinear axes of the three repulsion coils.

Figure 7:
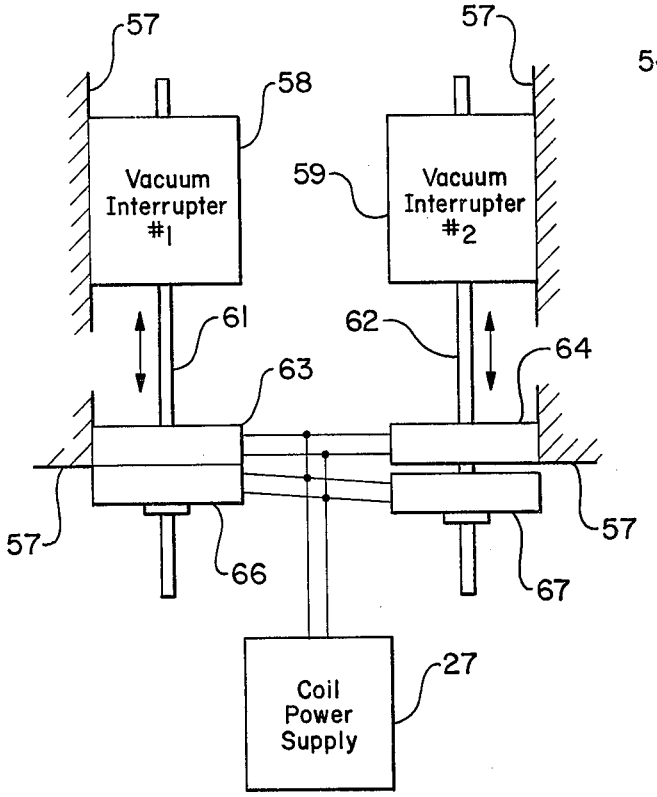
FIG. 7 is yet another embodiment of the repulsion coil actuator.

FIG. 7 shows an embodiment using two pairs of repulsion coils providing motion for actuating a mechanism such as a vacuum interrupter for example. The vacuum interrupter includes electrical contacts which are selectively closed or opened. A framework 57 has mounted thereto a pair of devices 58 and 59, which may be vacuum interrupters, within which the linear motion imparted to a pair of shafts 61 and 62 is utilized. A static coil 63 is mounted on framework 57 having a coil axis substantially aligned with the axis of shaft 61. A static coil 64 is also mounted on framework 57 having an axis substantially in alignment with the axis of shaft 62. Shafts 61 and 62 are free to move through static coils 63 and 64 respectively. A moving coil 66 is attached to shaft 61 and a moving coil 67 is attached to shaft 62. As shown in FIG. 7 static coils 63 and 64 are connected in parallel and moving coils 66 and 67 are also connected in parallel. All four of the foregoing coils are connected to power supply 27. The configuration of FIG. 7 is mechanically and electrically stable. When the repulsion coils are energized if shaft 62 initially moves through a greater distance than shaft 61, repulsion coils 63 and 66 are closer together, therefore developing more force for a given current from two stage power supply 27. Repulsion coils 63 and 66, being closer together, have less total inductance (as seen in FIG. 3) than repulsion coils 64 and 67 and therefore get more current for a given voltage from the two stage power supply 27. Consequently, coil pair 63/66 will exert more force on shaft 61 to bring the axial motion of shaft 61 into coincidence with the axial motion of shaft 62. In the instance where devices 58 and 59 are vacuum interrupters, both interrupters will operate in unison, and the contacts contained therein will open together.

A repulsion coil actuator has been disclosed which provides a large force sustained over a relatively large distance. The use of a two stage power supply for driving the repulsion coil actuator provides fast initial response plus sustained power which provides force over the relatively large distance. The repulsion coil actuator further provides for arresting the motion of the member set in motion by the force as well as for latching the mechanism in the actuated position through use of a holding solenoid assembly. Embodiments have been disclosed which produce fast opening and fast closing of contact pairs, extension of repulsion coil stroke, and synchronism between two or more actuators.

What is claimed is:

1. A repulsion coil actuator providing a force for imparting rapid movement to high voltage electrical contacts, comprising a framework, a first coil mounted on said framework having a first coil axis, a shaft being substantially in alignment with and disposed for linear motion along said first coil axis, a second coil mounted on said shaft having a second coil axis substantially in alignment with said first coil axis, A spring producing a spring force yieldably urging said first and second coils together, said first and second coils providing a repelling force therebetween when simultaneously electrically energized, said repelling force being greater than said spring force, a holding coil mounted on said framework, an armature mounted on said shaft disposed to move into and out of said holding coil, a first electrical contact on said framework, a second electrical contact on said shaft urged toward electrical engagement with said first electrical contact by said spring force, whereby said first and second electrical contacts are moved apart by said repelling force when said first and second coils are electrically energized and said electrical contacts are held apart when said armature moves into said holding coil and said holding coil is electrically energized.

2. A repulsion coil actuator as in claim 1 together with means disposed on said framework for absorbing the kinetic energy of said shaft in motion when said first and second electrical contacts are moved apart.

3. A repulsion coil actuator as in claim 1 together with a two stage power supply comprising first electrical charge storage means, second electrical charge storage means having a greater storage capacity than said first electrical charge storage means and being connected in parallel therewith, means for selectively coupling said first and second electrical charge storage means to said first and second coils, so that when a potential level is higher in said first than said second charge storage means and said means for selectively coupling is actuated, said first and second coils provide a high initial repelling force and a subsequent sustained repelling force through the linear motion of said shaft.

4. A repulsion coil actuator as in claim 1 together with a third coil attached to said framework and a fourth coil attached to said shaft, said third and fourth coils providing an additional repelling force therebetween when simultaneously electrically energized, said additional repelling force having a sense aiding said spring force, so that when said first, second and holding coils are de-energized and said third and fourth coils are electrically energized, said first and second electrical contacts are moved together.

5. A repulsion coil actuator as in claim 1 together with a third coil disposed between said first and second coils and movable relative to both said framework and said shaft, adjacent ones of said first, second and third coils being configured to repel each other when concurrently electrically energized, whereby said repelling force is exerted over an extended length of linear motion of said shaft.

6. A repulsion coil actuator as in claim 1 together with a third coil mounted on said framework having a third coil axis, an additional shaft disposed for linear motion along said third coil axis, a fourth coil mounted on said additional shaft having a fourth coil axis substantially in alignment with said third coil axis, an additional spring producing an additional spring force yieldably urging said third and fourth coils together, said third and fourth coils providing an additional repelling force therebetween when simultaneously electrically energized, said additional repelling force being greater than said additional spring force, an additional holding coil mounted on said framework, an additional armature mounted on said additional shaft disposed to move into and out of said additional holding coil, a third electrical contact on said framework, a fourth electrical contact on said additional shaft being urged toward electrical engagement with said third electrical contact by said additional spring force, said third and fourth coils being connected electrically in parallel with said first and second coils respectively, said repelling and additional repelling forces being higher for closer spacing between said first and second coils and said third and fourth coils, whereby said repelling and additional repelling forces remain in relative magnitudes so that said linear motions of said shaft and additional shaft are substantially synchronous and said third and fourth electrical contacts are moved apart by said additional repelling force substantially simultaneously with said first and second electrical contacts when all four of said coils are electrically energized and are held apart when said additional armature moves into said additional holding coil and said additional holding coil is energized.

7. Apparatus for rapid separation of high voltage contacts, comprising a framework, a first repulsion coil mounted on said framework, a second repulsion coil, said first and second repulsion coils having substantially colinear axes and producing a repulsion force therebetween when electrically energized, a moving member attached to said second repulsion coil and disposed for linear motion in the direction of said colinear axes, a static electrical contact on said framework, a moving electrical contact on said moving member disposed to contact said static electrical contact in the absence of said repulsion force, a two stage power supply providing a high initial energy transfer rate and a lower sustaining energy transfer rate, said first and second repulsion coils being connected to said two stage power supply, whereby said static and moving contacts are quickly separated by transfer of said high initial energy to said first and second repulsion coils and moved apart a predetermined distance by transfer of said lower sustaining energy to said first and second repulsion coils.

8. Apparatus as in claim 7 together with a spring providing a spring force urging said static and moving contacts together, said spring force magnitude being lesser than said repulsion force magnitude, whereby said static and moving contacts are held together in the absence of said repulsion force.

9. Apparatus as in claim 8 together with means disposed between said moving member and said framework for holding said moving member against said spring force so that said static and moving contacts remain at said predetermined distance apart after transfer of said high initial and lower sustaining energy.

10. Apparatus as in claim 9 wherein said means for holding, comprises an armature, and a field coil, said armature being disposed within said field coil when said static and moving contacts are spaced at said predetermined distance, said field coil operating to hold said armature therewithin when electrically energized.

11. Apparatus as in claim 7 together with a third repulsion coil disposed between and for relative motion with each of said first and second repulsion coils, said repulsion force being the summation of repelling forces between said first and third and said third and second repulsion coils, whereby the linear motion of said moving member is increased.

12. Apparatus as in claim 7 together with a shock absorber mounted on said framework positioned to contact said moving member after separation of said static and moving contacts and before movement through said predetermined distance, whereby the kinetic energy of said moving member stored therein during opening of said static and moving contacts is absorbed.

13. Apparatus for rapid separation of high voltage electrical contacts, comprising a framework, a first repulsion coil on said framework, a moving member disposed for linear motion along a predetermined axis through said framework, a second repulsion coil mounted on said moving member, said first and second repulsion coils when electrically energized providing a repulsion force therebetween urging said moving member in one direction along said predetermined axis, means mounted on said framework for yieldably urging said moving member in a direction opposite to said one direction, said repulsion force being greater in magnitude in said one direction than the yieldable force provided by said means for urging said moving member, a shock absorber arresting kinetic energy from said moving member while in motion due to said repulsion force, a power supply providing high initial power and lower sustained power, said first and second repulsion coils being connected to said power supply, whereby said moving member undergoes rapid motion initially when said repulsion coils are energized by said power supply which rapid motion is sustained until arrested by said shock absorber.

* * * * *